US009181642B2

(12) United States Patent
Cahuzac

(10) Patent No.: US 9,181,642 B2
(45) Date of Patent: Nov. 10, 2015

(54) TRIAXIAL TEXTILE ARMATURE, PROCESS FOR PRODUCING TRIAXIAL TEXTILE ARMATURES AND COMPOSITE MATERIAL PART

(71) Applicant: Vostech B.V., Elsloo (NL)

(72) Inventor: Georges Cahuzac, Le Bouscat (FR)

(73) Assignee: Vostech B.V., Elsloo (NL)

( * ) Notice: Subject to any disclaimer, the term of this patent is extended or adjusted under 35 U.S.C. 154(b) by 315 days.

(21) Appl. No.: 13/708,195

(22) Filed: Dec. 7, 2012

(65) Prior Publication Data

US 2014/0157974 A1 Jun. 12, 2014

(51) Int. Cl.

| | |
|---|---|
| ***D04C 3/00*** | (2006.01) |
| ***D04C 1/02*** | (2006.01) |
| ***D04C 3/24*** | (2006.01) |

(52) U.S. Cl.

CPC .. *D04C 3/00* (2013.01); *D04C 1/02* (2013.01); *D04C 3/24* (2013.01); *D10B 2403/02411* (2013.01); *D10B 2505/02* (2013.01)

(58) Field of Classification Search

CPC ..... D04C 3/00; D04C 3/24; D04C 1/02
USPC ..... 87/7, 13, 33; 428/36.3
See application file for complete search history.

(56) References Cited

U.S. PATENT DOCUMENTS

| | | | | |
|---|---|---|---|---|
| 2,788,700 A | | 4/1954 | Crossley et al. | |
| 3,955,467 A | * | 5/1976 | Johnson, Jr. | 87/7 |
| 4,312,913 A | * | 1/1982 | Rheaume | 442/187 |
| 4,848,414 A | * | 7/1989 | Cahuzac | 139/411 |
| 5,619,903 A | * | 4/1997 | Rogers et al. | 87/7 |
| 5,711,960 A | * | 1/1998 | Shikinami | 424/426 |
| 6,495,227 B1 | | 12/2002 | Cahuzac | |
| 8,443,706 B2 | * | 5/2013 | Egres, Jr. | 87/8 |
| 2003/0017290 A1 | * | 1/2003 | Cahuzac | 428/36.3 |

FOREIGN PATENT DOCUMENTS

| | | | | |
|---|---|---|---|---|
| EP | 0069957 | | 1/1983 | |
| EP | 113196 A1 | * | 7/1984 | D04C 1/06 |
| EP | 0839941 | | 5/1998 | |
| FR | 1105915 | | 12/1955 | |
| FR | 2884836 | | 10/2006 | |
| FR | 2976297 | | 12/2012 | |

OTHER PUBLICATIONS

Opinion dated Jun. 4, 2012, relating to FR1101750.

Search Report dated May 25, 2012, relating to French Application FR1101750.

Search Report dated Aug. 9, 2013, relating to European Application EP12196166.8.

* cited by examiner

*Primary Examiner* — Shaun R Hurley
(74) *Attorney, Agent, or Firm* — Barnes & Thornburg LLP

(57) ABSTRACT

A triaxial textile armature is provided for making composite materials. The armature includes a central layer of axial yarns cross-linked by bias yarns extending in a first and a second direction the bias yarns extending in the first direction passing through the central layer of axial yarns in even intervals between axial yarns of the central, and the bias yarns extending in the second direction passing through the central layer of axial yarns in odd intervals.

15 Claims, 6 Drawing Sheets

TRIAXIAL TEXTILE ARMATURE, PROCESS FOR PRODUCING TRIAXIAL TEXTILE ARMATURES AND COMPOSITE MATERIAL PART

The present invention relates to the domain of composite materials that are constituted by a textile armature, or long fiber reinforcement, impregnated with a resin named matrix. That invention is a new type of armature and its manufacturing process that allows obtaining low cost parts with complex shapes, open or closed, with high mechanical performances (value). That invention is more precisely a new type of textile architecture that is a triaxial braid with a majority of the yarns in the longitudinal direction and a constant thickness. For obtaining from those braids high performance composite materials, it's necessary that the yarns in the three directions have minimal fiber crimp and create few internal voids by their crossing. That is the result achieved by that invention.

We can give as an example of the prior art the fabric QISO™ from the A&P company. That triaxial fabric obtained by braiding on a regular braiding machine is said ISO as it has the same amount of fiber in the three directions, 0°, +60° and −60°. But the geometrical analysis shows that it's impossible to recover continuously the fabric surface at the same time by the oblique or bias yarns at + or −60° and by the axial yarns at 0°.

The reason for that is the crossing of the bias yarns between two axial yarns.

The geometrical analysis of that crossing shows that if we want to cover all the surface by the bias yarns, without any void between two bias yarns, it is necessary to create a void between two axial yarns as big as their own width, that is to say that it is possible to recover only half part of the surface by the axial yarns. Hence, to have the same amount of fibers in the three directions, it's necessary to double the thickness of those axial yarns. The surface of such a fabric is made by alternate ribbons holding two layers of bias yarns and ribbons holding fourth layers, the two bias yarns and two axial yarns. Therefore that fiber architecture is not optimized and a part made by many layers of such a fabric will not have a fiber volume ratio high enough for making aeronautical parts. Such a fabric is manufactured on a regular braiding machine that produces textile architectures not good enough for making high performance composite materials.

The invention resolves that problem because it allows manufacturing triaxial braids with a constant thickness and a majority of fiber in the axial direction while keeping all the other advantages of the braiding process that creates at high speed in-shape parts, by introducing in the center of the braiding machine a mandrel that is covered by the yarns. That way of making parts is often named overbraiding.

A previous try to resolve that problem can be found in the French patent No. 2 753 993 of Georges CAHUZAC that creates a high quality fiber architecture. That textile armature holds layers of axial yarns disposed in quincunxes and linked two by two by the bias yarns. The first axial layer is linked with the second layer by the bias yarns with one orientation while the second layer is linked with the third one by the bias yarns with the other orientation. That textile armature is well done but is not symmetrical into its thickness and that can create some deformation during the polymerization with shrinkage of the resin matrix.

Its manufacturing process consists in using a braiding machine that has notched wheels disposed in quincunxes inside a cylinder. The path of the moving bobbins holding the bias yarns is obtained by the combination of the rotation of those notched wheels with the changing of angle of guiding needles. That mechanism is complex and could block the functioning if not correctly tuned. The gears that are disposed in quincunxes under a cylinder are difficult to machine correctly. This braiding machine is expensive to build and uneasy to tune.

Another example of prior art is given in the French patent No 2 804 133 that describes a circular multilayer braiding machine that is made with fourth concentric rows of notched wheels and their gears. All the wheels have fourth notches. Fixed parts with crossed paths are disposed between each two wheels to give the required paths for the bobbin carriers. The axial yarns are introduced inside tubes disposed in the center of each wheel. This braiding machine has a reliable functioning, but cannot do a high quality fiber armature because the bias yarn crossings create a fiber architecture holding many axial voids in which it is impossible to insert yarns. But the mechanical characteristics of a composite material part depends of the way in which the yarns are well disposed in accordance with the efforts (strengths), without any yarn bending and without creating by their crossing voids filled only by resin, decreasing the fiber volume ratio of such a part and creating yarn bending during compaction.

That problem was solved in the English patent GB 8234187 or EP 0113196 in which is described a multilayer braiding machine that holds rows of tubes between the rows of notched wheels in order of inserting the axial yarns necessary to fill these voids. That machine has notched wheels that are not adjacent and are disposed on two different levels. The difference in rotational speed between each row allows the functioning of that machine only with few bobbin carriers, and with stops between two wheels. In reality, that braiding machine cannot work because there will be always a blocking step reached after some rotations.

Another example of prior art is given in the French patent No. FR2884836 invented by Georges CAHUZAC. The described multilayer textile armature allows the realization of good quality parts. Its manufacturing process consists in using a very special type of braiding machine in which the bobbins carriers move sequentially in zigzag, which is a limitation in the braiding speed. The simultaneously deposition of all the yarn layers of a part compensates that slowing but it's a less flexible process than a speedy deposition of some independent layers with optimized braiding for each one.

Our new textile armature for making composite material parts is based on using braiding machines with two rows of notched wheels known at least from the XIX$^{th}$ century since we can find a description of an improvement of such a machine in the U.S. Pat. No. 886,825 of May 5, 1908. A more recent example of such braiding machines can be found in the French patent No. 1.105.915 of May 20, 1954 from Arthur CROSSLEY and Henri Morton CROSSLEY in which are described two braiding machine, one with two rows of notched wheels and one with three rows of notched wheels. But the using of those braiding machines was fallen into disuse, if they ever have been built, and their tremendous interest for making armatures for composite material parts was not seen until today.

Our present invention comprises a high quality triaxial textile armature, very useful to manufacture cheaply lengthy parts directly in shape, in order of remediating at a lack in the range of existing processes. An armature in accordance with this invention has three fiber orientations, the first one axial and the two others making a angle, by example +60° and −60°, with the axial direction, in which those bias yarns do not cross each other during getting through the layer of axial yarns, but get it through in their respective odd and even intervals. The +60° yarns pass through the axial yarn layer in each odd interval while the −60° yarn passes through it in each even interval. The quality of those armatures is improved by adding little axial yarns on the upper and lower side of those intervals to obtain armatures with three layers of axial yarns, in which the central layer yarns are bigger than the side layer axial yarns. Those armatures have a remarkably constant thickness and all their yarns have very smooth paths.

The axial yarns in the central layer can have a round or elliptic cross section but more preferably the cross section of the axial yarns has a flattened cross section. This flattened cross section is needed to create a layer that has a minimum thickness and a maximum strength. The size of the cross section of the axial yarns of the central layer in a direction basically perpendicular to the thickness is at least twice the size of the cross section in the same direction of the axial yarns of the side layer or the bias yarns. It is noted that all kinds of cross sections can be applied.

The process to manufacture those armatures in accordance with this invention is a braiding process, that is to say a process that moves the yarn bobbins by the way of rotating adjacent wheels exchanging each other's their bobbin carriers.

A braiding machine for making an armature in accordance with this invention has to be built with two circumferential rows of adjacent wheels and three rows of tubes for introducing the axial yarns. The tubes of the external and internal rows are situated at the center of the notched wheels, while the tubes of the central row are situated at or near the crossing of the diagonals linking the axes of fourth adjacent wheels. Those braiding machines can be built within two ways of disposing the rotating wheels. The first way is in disposing the two rows of wheels on a disk. The second way is in disposing the two rows of wheels inside a cylindrical or spherical ring. In the both cases the yarns are laid on a central mandrel after leaning on a fixed ring surrounding it.

The annexed figures will help to better understand how this invention can be made.

DETAILED DESCRIPTION OF THE SEVERAL VIEWS OF THE DRAWINGS

Figure 1:
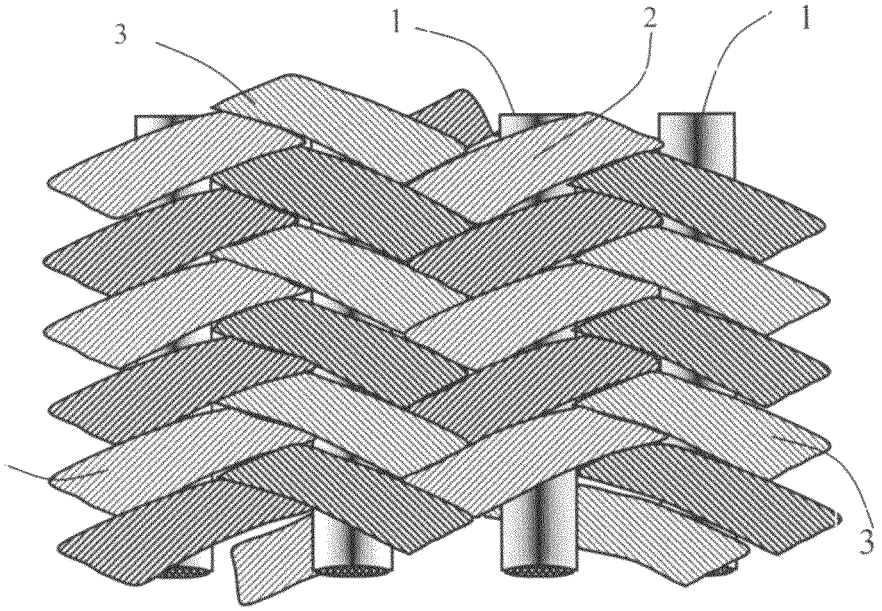
FIG.1 (prior art)
FIG. 1 is a view of a braid made in accordance with prior art.

The FIG. 1 is a view of a braid made in accordance with prior art. Inside that braid the axial yarns are separated by spaces equal or larger than their own width to allow the passing of the bias yarns through the axial yarns while there are crossing each other's into those same spaces. The composite material part obtained by laying many of such braids can't be a high quality part because each braided layer has not a constant thickness.

Figure 2:
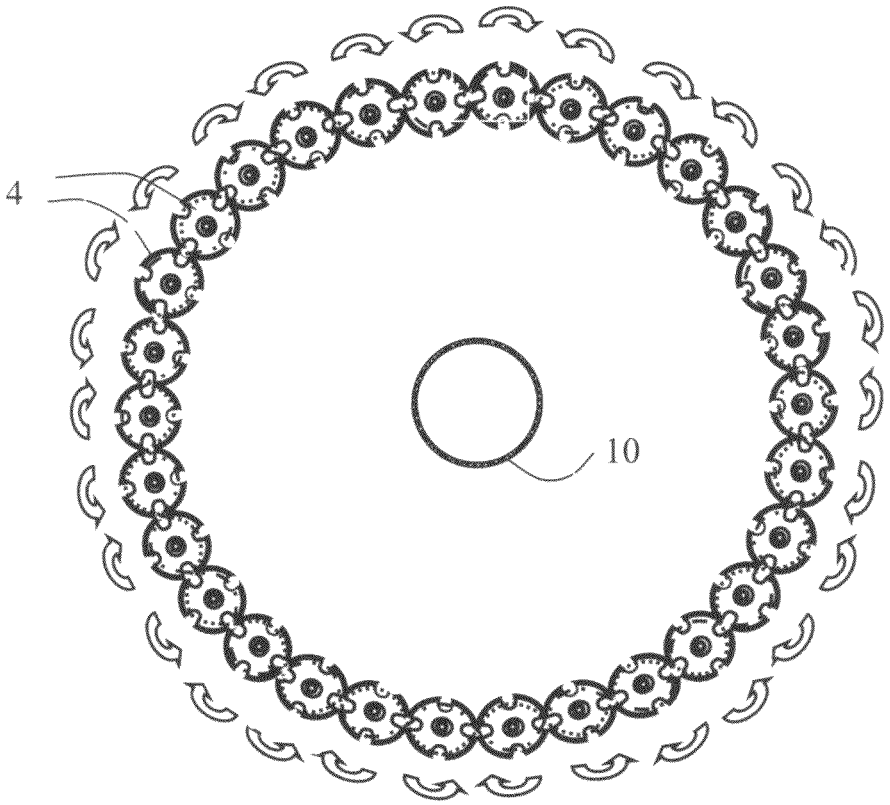
FIG.2 (prior art)
FIG. 2 is a schematic view of the disposition of the notched rotating wheels into a braiding machine made in the prior art for making armatures of composite material parts.

The FIG. 2 is a schematic view of the disposition of the notched rotating wheels into a braiding machine made in the prior art for making armatures of composite material parts. That machine has only one row of notched wheels that are making by their rotations the bobbins carriers holding the bias yarns moving into opposite directions along two crossed paths. Those yarns are forming the braid around a central mandrel. The axial yarns are passing through the center of each notched wheel and are placed into the braid as shown on FIG. 1.

Figure 3:
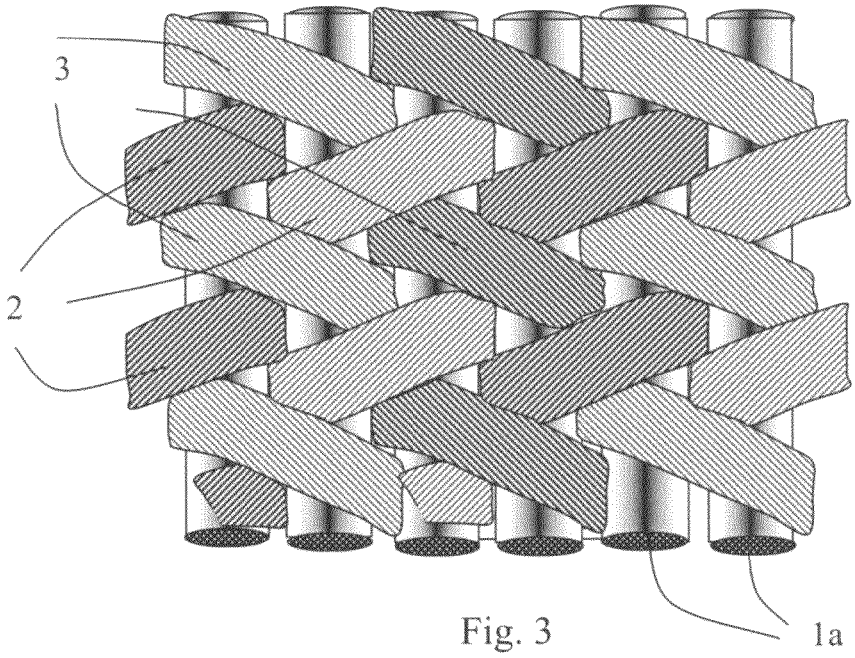
FIG. 3 shows a first example of armature in accordance to the invention.

The FIG. 3 shows a first example of armature in accordance to the invention. The bias yarns (2) passes over two axial yarns (1*a*) then passes under two axial yarns (1*a*). The bias yarns (3) also passes over and under two axial yarns (1*a*) but their passing through the layer of yarns (1*a*) are shifted of one interval with that of the bias yarns (2). One can say that this armature is characterized by the getting of the bias yarns (2), constituting a first direction, through the layer of axial yarns (1*a*) in their intervals said even and the getting of the bias yarns (3), constituting the second direction, through that layer of axial yarns (1*a*) in their intervals said odd.

In this armature, those axial yarn (1*a*) intervals can be smaller than in the armature showed FIG. 1 because the bias yarns (2) and (3) get through the layer of yarns (1*a*) in separated intervals and the yarns (2) never cross the yarns (3) in those intervals. The unit cell that characterizes this fibre architecture is made of one layer of fourth axial yarns linked by two sets of N crossed bias yarns, N being an even number, equal at two on this figure.

Figure 4:
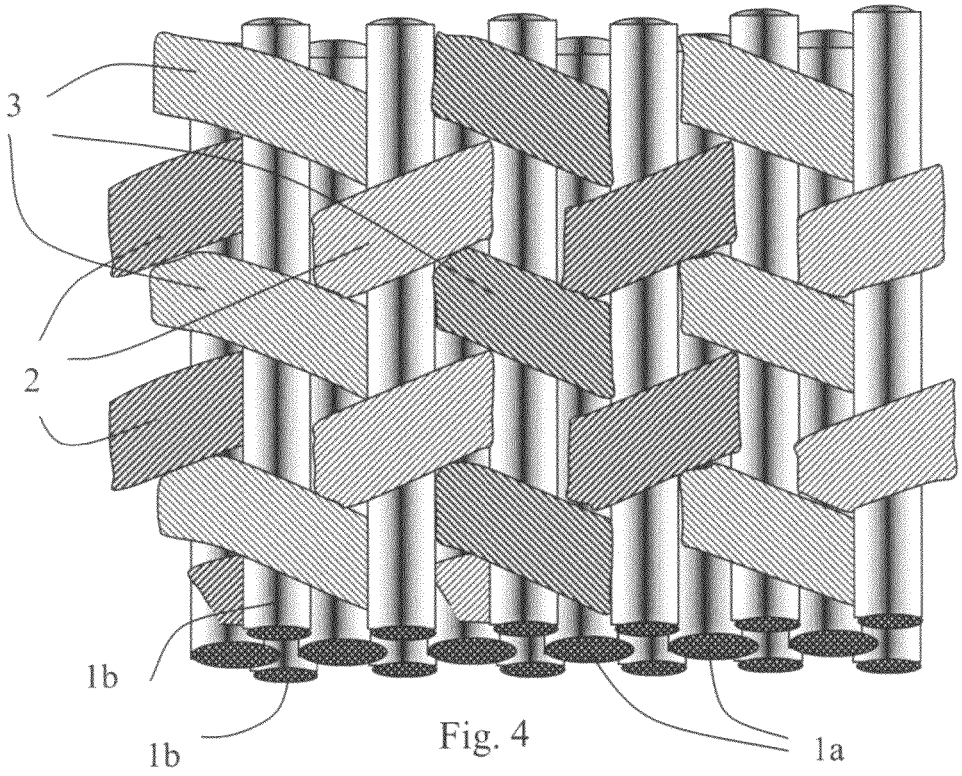
FIG. 4 shows a second example of armature in accordance with the invention.

The FIG. 4 shows a second example of armature in accordance with this invention. Axial yarns (1*b*) were introduced over and under the intervals between the axial yarns (1*a*) for improving the continuity of thickness of this armature. The unit cell that characterizes this fibre architecture is made by 12 axial yarns disposed on three layers, with the yarns (1*a*) of the central layer in quincunxes with the yarns (1*b*) of the side layers, linked by two crossed sets of N yarns, N being an even number, equal at two for the armature shown on this FIG. 3. Each bias yarn (2) or (3) get over 6 and under 6 axial yarns (1*a*) and (1*b*) while crossing 2*N yarns (3) or (2) of the other set of bias yarns. The created armature is suitable for making high performance composite material because its thickness is uniform and have a majority of the yarns in the axial direction. The armature shown on FIG. 4 has the sections of the yarns (1*a*) of the central layer roughly two times bigger than the ones of yarns (1*b*) of the side layers. As the place for each central axial yarn is two times larger and two times thicker than the one of the side axial yarn, its section can be usually chosen between two times and four times bigger than the section of the side axial yarns in order to improve the thickness homogeneity of that armature.

Figure 5:
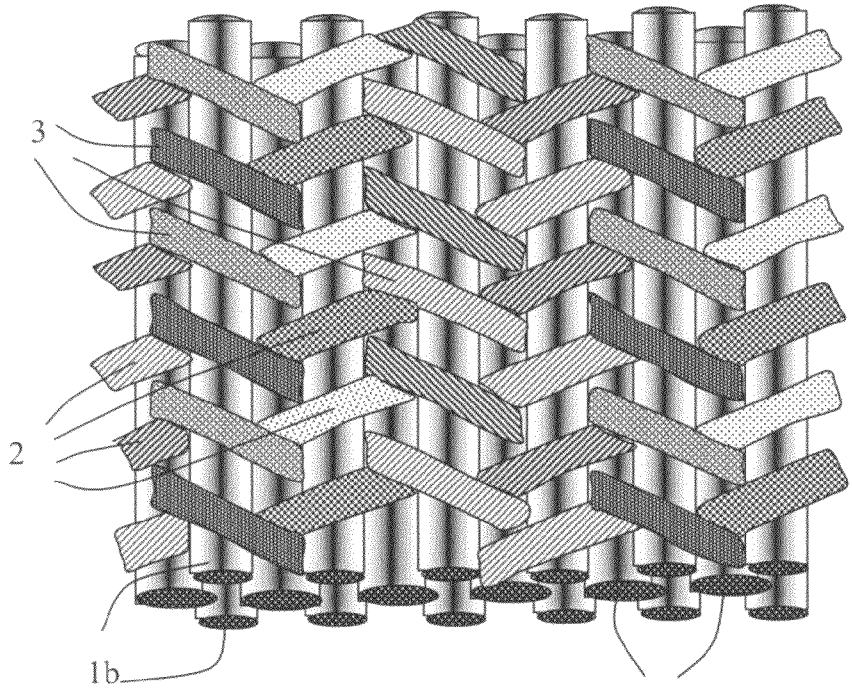
FIG. 5 shows a third example of the armature object of the invention.

The FIG. 5 shows a third example of the armature object of the invention. The N number of each set of bias yarns was doubled by comparison with the FIG. 4, therefore it is equal at four. That allows having an armature in which the wideness of the bias yarns (2) or (3) is the same that the one of the side axial yarns (1*b*) for an angle of 60°.

Figure 5A:
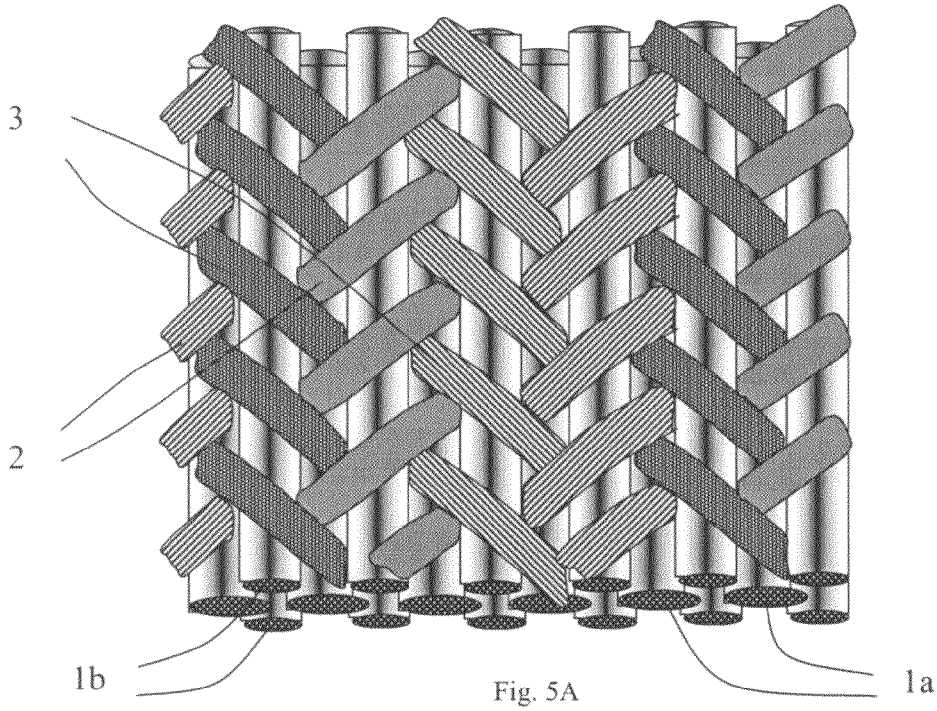

The FIG. 5*a* shows a fourth example of the armature object of this invention. The N number of each set of bias yarns has been increased to six. That allows having an armature in which the width of the bias yarns (2) or (3) is the same that the one of the side axial yarns (1*b*) for an angle of 45°.

Figure 6:
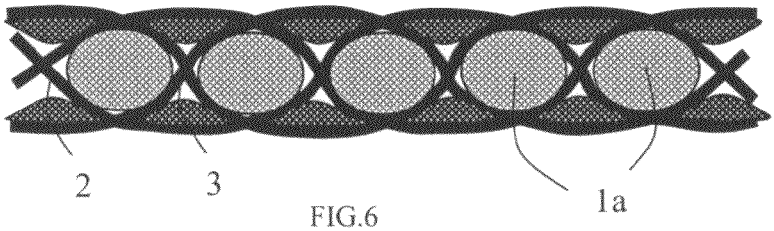
FIG. 6 shows a section view of another example of armature in accordance with the invention.

The FIG. 6 shows a section view of another example of armature in accordance with this invention in which a thick central layer is obtained by using as axial yarns (1*a*) a light density product, by example a foam in order of creating an armature suitable for making the center part of a sandwich structure usable for impregnating by resin infusion. The bias yarns have in that armature the right positioning to carry the shear loads between the skins, the same positioning that we can find in the French patent Nb. 2.918.599.

Figure 7:
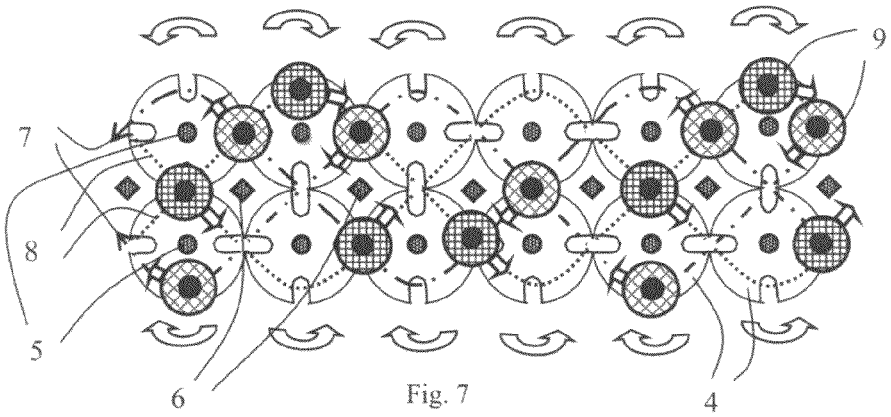
FIG. 7 shows a flat sketch of the disposition of the two rows of notched wheels (4) and three rows of tubes (5 and 6) in accordance with the invention.

The FIG. 7 shows a flat sketch of the disposition of the two rows of notched wheels (4) and of the three rows of tubes (5 and 6) in which are introduced the axial yarns (1*a* and 1*b*) for making armatures in accordance with this invention. Each wheel has four notches as in any regular braiding machine. The tubes (5) in which the axial yarns (1*b*) of the side layers are introduced are situated at the center of each notched wheel while the tubes (6) in which the axial yarns (1*a*) of the central layer are introduced are situated near the crossing of the diagonals linking the axes of fourth adjacent wheels. All those wheels (4) are linked with gears (14) not shown on that sketch but visible on FIG. 10. Each bobbin carrier (9) is guided by grooves (7) and (8) machined into a plate situated between the wheels and the gears. When all the wheels are rotating, the bobbin carriers charged with the bias yarns (2) are moving to the right side guided by the grooves (7) while the bobbin carriers charged with the bias yarns (3) are moving to the left side guided by the grooves (8). Their guiding grooves are machined in such a way to alloy the using of bobbins as big as possible as passing in the center between the tubes (5) and (6). By introducing axial yarns only into the central row of tubes (6), the armature visible on FIG. 3 is obtained. By introducing yarns into the three rows of tubes, the armatures visible on FIG. 4 or 5 are braided. For avoiding that the bobbin carriers collide during braiding, their number is limited at two on each trajectory going from one wheel to the following fourth. Hence the armature visible on FIG. 5*a* is not doable by using wheels with four notches.

Figure 7A:
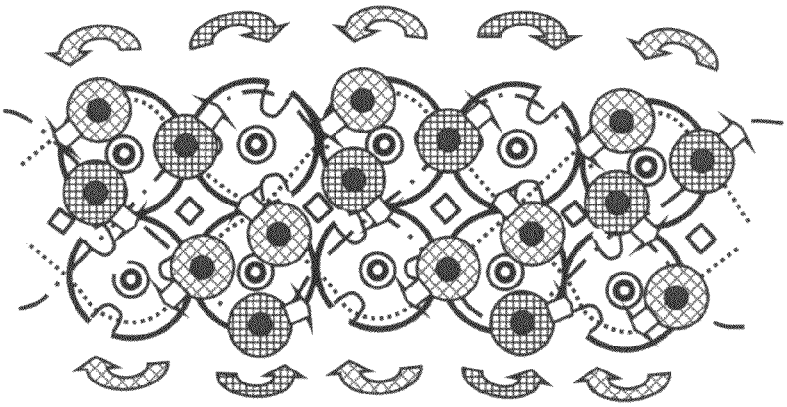

The FIG. 7*a* shows the same sketch on which the number of notches on each wheels has been decrease to three. The number of bobbin carriers (9) can be increased to three on each trajectory without colliding. Hence the armature visible on FIG. 5*a* is doable by using wheels with only three notches.

It's interesting to note that when the number of notches is even on the two rows of wheels, it's possible to put only two bobbin carriers on each trajectory of eight notches. When the number of notches of the wheels is odd on the two rows, it's possible to put a bobbin carriers each two notches. And when the number of notches is odd on a row and even on the other one, it's possible to put a bobbin carrier each three notches.

Figure 8:
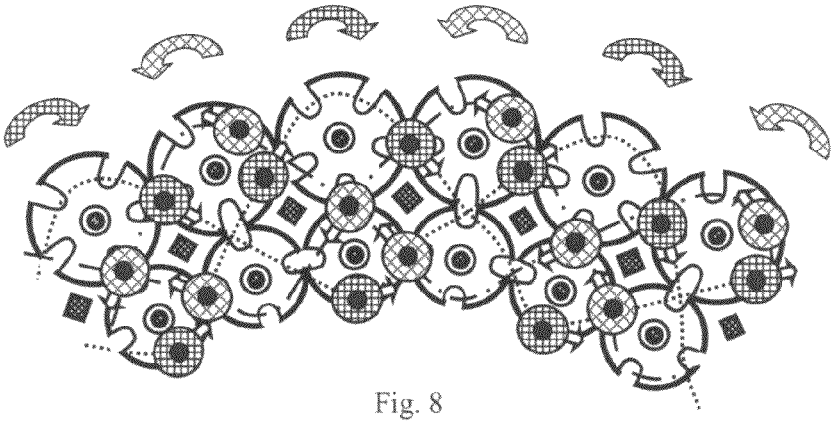
FIG. 8 shows a disposition of wheels on the internal row that have four notches, and wheels of the external row that have 5 notches.

The FIG. 8 shows such a disposition of wheels on the internal row that have four notches, and wheels of the external row that have 5 notches. Hence it's possible to put three bobbin carriers on each trajectory of 9 notches.

Figure 9:
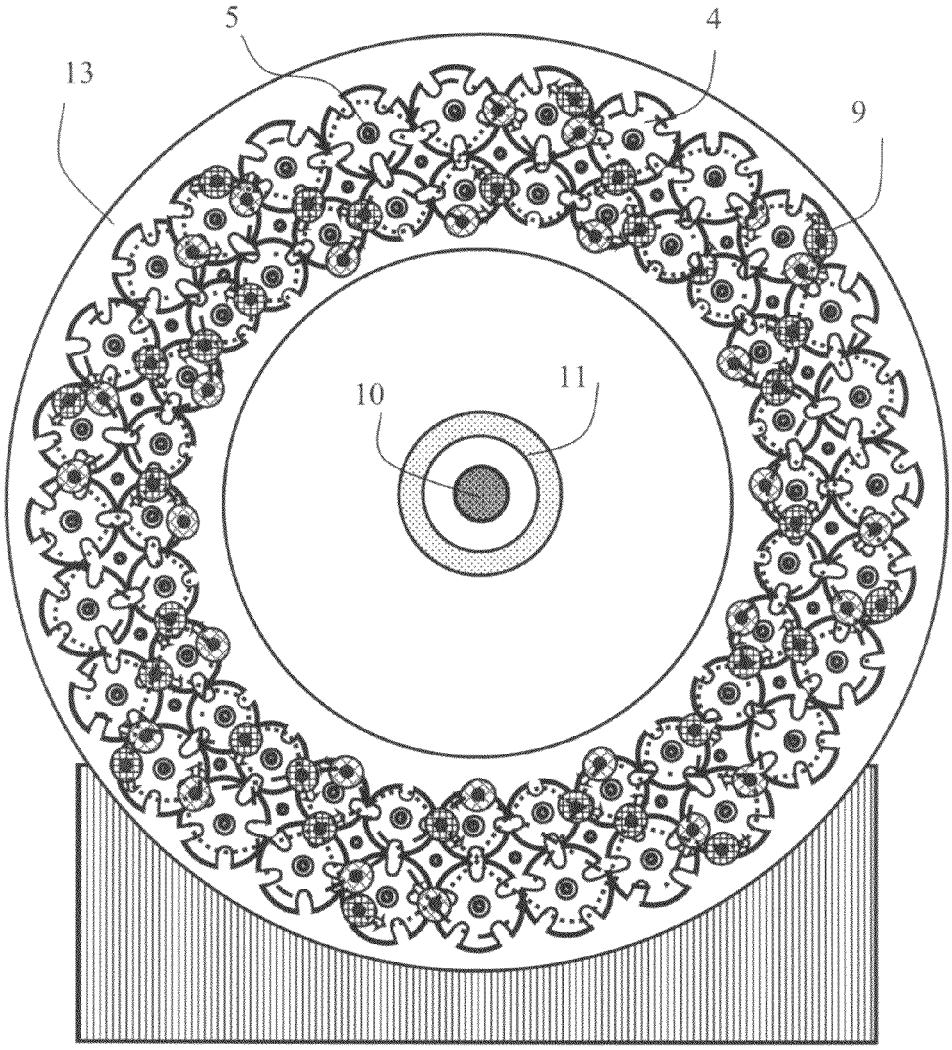
FIG. 9 shows a general front view of a braiding machine able to make the armature object of the invention.

The FIG. 9 shows a general front view of a braiding machine able to make the armature object of this invention. Its notched wheels are disposed on a vertical disk (13). That vertical disposition is usually named at horizontal axis. That disposition is convenient for intruding a mandrel (10) that will be recovered by the yarns.

Figure 10:
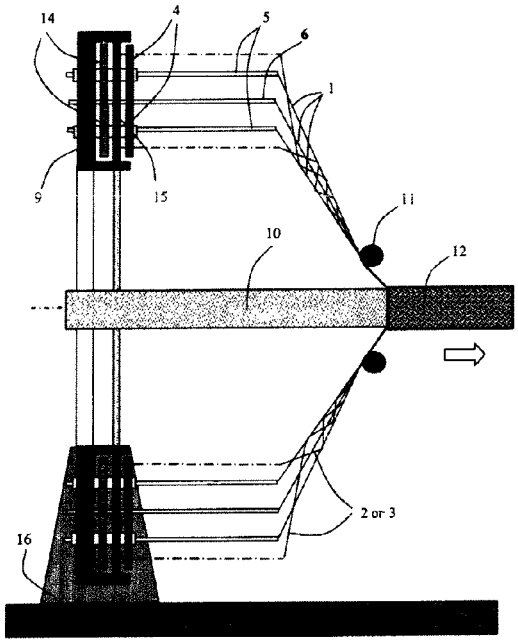
FIG. 10 is the side view of that braiding machine showing the gears (14) driving the wheels (4) and the plate (14) in which the guiding grooves are machined.

The FIG. 10 is the side view of that braiding machine showing the gears (14) driving the wheels (4), the plate (14) in which the guiding grooves are machined. and the path of the yarns from the ends of the tubes (5) and (6) to the mandrel 10 on which they create the armature 12 after sliding inside the ring (11).

Figure 11:
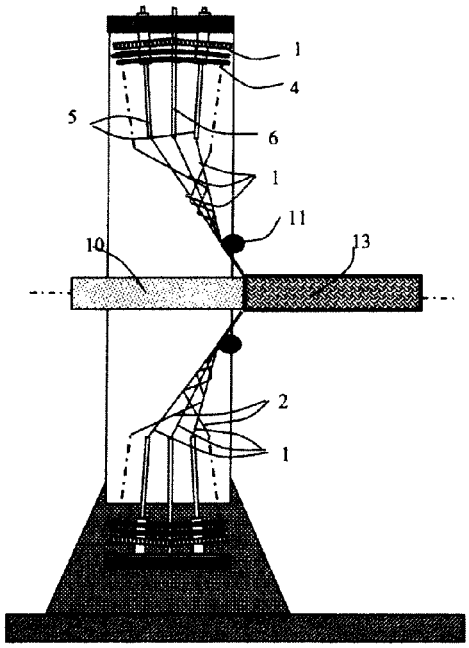
FIG. 11 shows the side view of a braiding machine made by disposing the two rows of wheels symmetrically inside a big ring.

The FIG. 11 shows the side view of a braiding machine made by disposing the two rows of wheels symmetrically inside a big ring. The surface on which the bobbin carriers move is a spherical surface.

Figure 12:
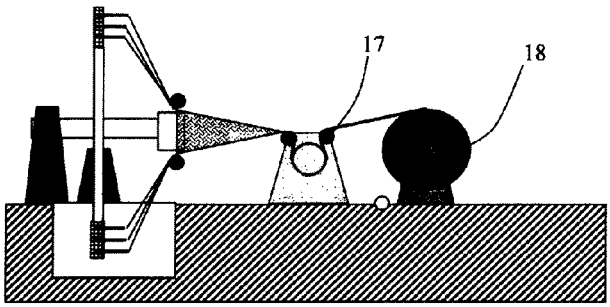
FIG. 12 shows a braiding machine with its lower part installed into a pit.

The FIG. 12 shows a braiding machine with its lower part installed into a pit for keeping the area of braid armature formation at a height convenient for the operators or for making easier the introduction of a great length mandrel into the center of that braiding machine. The created braid goes on a tensile apparatus (17) that makes the braid (12) moving at a constant speed and winds it on a drum (18).

We will describe a first example of braiding machine built for making armatures in accordance with this invention and also some examples of armatures manufactured on it.

That braiding machine, shown sketchily on the FIGS. 9 and 10, is mainly constituted by two rows of 28 notched wheels (4). That number N is a multiple of 4 so those braids will have a integer number of unit cells. The wheels of the internal row have 4 notches while the wheels of the external row have 5 notches. Those three numbers are chosen in accordance with the formula that link the diameters of the wheels on two concentrical rows with their number N:

$$Dext/Dint=(1+\sin(PI/N))/(1-\sin(PI/N)),$$

in which Dext is the diameter of a wheel in the outer row of wheels, Dint is the diameter of a wheel in the inner row of wheels and N is the number of notched wheels per row.

As N=28, that ratio is equal at 1.25216 that is very close of 1.25 the ratio 5/4 of the numbers of notches.

Those notched wheels are linked with gears (14) that are also in that ratio of 1.25 between their two rows. The diameter of the wheels of the internal row is 160 mm and the diameter of the ones of the external row is 200 mm. That machine can receive 84 bobbin carriers maximum. As the number of notches is even on the internal row of wheels and odd on the external row, it's possible to put a bobbin carrier each three notches. Each path corresponding to the unit cell, that is to say covering the distance between five axial yarns (four steps), is made of 4+5=9 notches and can receive three bobbin carriers without colliding.

As the bobbins and the bobbins carriers are usual components of braiding machines, they are not described in that patent.

A mandrel (10) is situated in the machine center. Its shape can be the internal shape of the required part. So, its shape can be other than round, rectangular by example, have a variable size or a curvature to braid a fuselage frame by example. It can move to pull the braid or be fixed and the braid slides on it to be wounded around a drum (see FIG. 12). A cutting mechanism can be placed between the mandrel (10) and the drum (18) to wind on it a flat triaxial fabric.

A ring (11) surrounds the mandrel (10) and help to facilitate the formation of the braided armature (12). It is linked at the machine frame (16) by some rods not shown here. The tuning of the mandrel speed, or of the sliding speed of the braid on it when the mandrel does not move, with the rotation speed of the wheels adjusts as required the angle of the bias yarns with the axial yarns.

That braiding machine allows braiding an armature with three layers of 28 axial sites of yarns but, as we can put into the central layer two to four yarns, that braid has the equivalent of 112 to 168 axial yarns.

The armature created by this braiding machine is similar at the one shown on the FIG. 5. When braiding around a mandrel of 200 mm of diameter, using as braiding yarn 50K carbon yarn from SGL and putting four axial yarns in the center tubes, that braiding process produces triaxial armatures with the following features: with braiding a 45° braiding angle and a fiber volume ratio of 60%, a thickness of 1.5 mm, 59% of axial fibers and 41% of bias yarn, with a 60° braiding angle, a thickness of 1.7 mm, 50% of axial fibers and bias fibers. That triaxial armature will be produced at a rate of 320 Kg/hour for a 45° braiding angle, 220 Kg/hour for a 60° braiding angle.

We will describe a second example of bigger braiding machine and also some examples of armatures manufactured on it.

That big size braiding machine, visible FIG. 12, has two rows of 144 wheels. That number is a multiple of four so the number of unit cell is integer. Each wheel has only three notches, because it's possible to put more bobbin carriers without colliding than if we had used more regular wheels with four notches. When the number of notches is odd on the both rows of wheels, it is possible to put on a unit cell trajectory of 6 notch intervals a bobbin each two intervals, and so we can put three bobbin carriers on each trajectory. As there are four paths per unit cell, the number of bobbins carriers is 3*4=12 each four wheels or 144/4*12=432. The number of tubes for introducing the axial yarns is the same: 144*3=432.

The internal wheel diameter is 200 mm and the external wheel diameter is 208.9 mm. The ratio (1+sin(PI/N)/(1−sin (PI/N)=1,0446 is enough close of 1 for keeping the change of speed, when the bobbin carriers pass from one row of wheels at the other one, at an acceptable value. The diameter of the bobbin carriers is 110 mm and the diameter of their bobbins is 80 mm. The external diameter of that braiding machine is 10 m. It will be useful to install it partially into a pit to facilitate the operator work.

The braided armature will have the equivalent of 576 to 864 axial yarns depending of the number of yarns put in each tube of the central row.

When braiding around a mandrel of 1 m of diameter, using as braiding yarn 50K carbon yarn from SGL and putting four axial yarns in the center tubes, that braiding process produces triaxial armatures with the following features: with a 45° braiding angle, for a fiber volume ratio of 60%, a thickness of 1.52 mm, 59% of axial fibers and 41% of bias fibers, with a 60° braiding angle, a thickness of 1.78 mm, 50% of axial fibers and bias fibers. That triaxial armature will be produced at a rate of 1600 Kg/hour for a 45° braiding angle, 1100 Kg/hour for a 60° braiding angle.

By comparison with the actual processes for making composite material parts, this new process will allow manufacturing in-shape reinforcement for composite parts, often named preforms, cheaper than any other process as all the yarns in three directions are wrapped together on the mandrel. By comparison with the fiber placement, the fiber laying rate is so much higher than it is a sure bet to use this new process. And the price of the raw material is also cheaper as that process uses only dry fiber without all the troubles generated when using pre-impregnated yarns. When used into a manual laying-up process, the using of fabrics with the equivalent of four layers of yarns, two axial and two bias ones, decreases the part laying-up time. By comparison with multiaxial fabrics, or non-crimp-fabrics, it allows the realization of closed in-shape parts. It is also well known that interlock textile architectures are better against delaminating and for chock absorbing.

This process is well suited in the aeronautic world for making jet motor fan blades, helicopter or plane blades and for any type of lengthy part as fuselage frames, stiffeners, and frames of ultra light aircraft. Those new armatures will be convenient for making bike-, motorcycle-, car- or truck frames, and also their in-shape recovering panels. They can also be used for making mechanical parts as torque shafts due to the high rigidity in flexion and torsion allowed by the high quality of their fiber architecture.

Those armatures are obtained with a closed shape, but it is easy to axially cut them to obtain flat triaxial fabrics then bent them to obtain any kind of profiles.

This process will be in the future a very important process for making cheaply high quality composite parts with a large range of applications.

The invention claimed is:

1. Triaxial textile armature for making a composite material comprising a central layer of axial yarns, cross-linked by bias yarns extending in a first and a second direction, characterized in that the bias yarns pass alternatively over two axial yarns of the central layer and then pass under two axial yarns of the central layer, the passing through the central layer of axial yarns being separated by one interval between axial yarns of the central layer in order to prevent the bias yarns extending in the first direction and the bias yarns extending in the second direction from passing through the central layer of axial yarns in the same interval, the bias yarns extending in the first direction passing through the central layer of axial yarns in even intervals between axial yarns of the central layer, and the bias yarns extending in the second direction passing through the central layer of axial yarns in odd intervals.

2. Triaxial textile armature according to claim 1, characterized in that the axial yarns have a cross section size that has at least twice the size of the cross section of the bias yarns.

3. Triaxial textile armature according to claim 1, characterized in that the composite material comprises the central layer of axial yarns and at least two side layers of axial yarns, wherein the side layers of axial yarns are placed on opposite sides with regard to the central layer of axial yarns, the axial and the side axial layers being cross-linked by the bias yarns extending in the first and the second direction, wherein an elementary pattern is formed of twelve axial yarns arranged in three layers, wherein the axial yarns of the central layer are placed in quincunxes with regard to the axial yarns of the side layers, linked by two crossed sets of N bias yarns each, wherein each bias yarn extending in one of the first and the second direction passes alternatively over six axial yarns and under six axial yarns while crossing 2*N yarns extending in the other of the first and the second direction.

4. Triaxial textile armature according to claim 3, characterized in that the central layer of yarns comprises axial yarns that have a cross section size that has at least twice the size of the cross section of the axial yarns of the side layers.

5. Triaxial textile armatures according to claim 1, characterized in that the yarns of the central layer comprise a material having a low specific density, the specific density of the material being in the range of 20 $kg/m^3$ and 300 $kg/m^3$.

6. Process for producing triaxial textile armatures according to claim 1, using a braiding machine comprising two adjacent circular rows of notched wheels, and two circular rows of tubes for introducing axial yarns at a rotation axis of each notched wheel, wherein central tubes are placed near an intersection of the diagonals of the figure formed by the axes of rotation of four adjacent notched wheels and wherein the axial yarns are introduced into these central tubes.

7. Process according to claim 6, characterized by using the braiding machine in which the two adjacent rows of notched wheels are placed concentrically on a disk.

8. Process according to claim 6, characterized by using the braiding machine in which the number of notches of the wheels differs between the two rows in order to achieve a same peripheral speed, the ratio of the number of notches of the wheels between an external and an internal row being equal to the ratio between the diameter of wheels in the external row and the diameter of the wheels in the internal row.

9. Process according to claim 6, characterized by using the braiding machine in which the two adjacent ranges of N notched wheels are disposed symmetrically inside or outside a cylindrical or spherical ring.

10. Process according to claim 6, characterized by using the braiding machine in which the number of notches of the wheels is three on the two rows.

11. Process for producing triaxial textile armatures according to claim 4, using a braiding machine comprising two adjacent circular rows of notched wheels, and three circular rows of tubes for introducing the axial yarns, comprising at least a central tube and two side tubes and, wherein the central tube is placed near the intersection of the diagonals of the figure formed by the axes of rotation of four adjacent notched wheels, and wherein the axial yarns that are introduced into the central tube are at least twice as big in cross-sectional size than the axial yarns that are introduced into the side tubes.

12. Process according to claim 11, characterized by using the braiding machine in which the two adjacent rows of notched wheels are placed concentrically on a disk.

13. Process according to claim 11, characterized by using the braiding machine in which the number of notches of the wheels differs between the two rows in order to achieve a same peripheral speed, the ratio of the number of notches of the wheels between an external and an internal row being equal to the ratio between the diameter of wheels in the external row and the diameter of the wheels in the internal row.

14. Process according to claim 11, characterized by using the braiding machine in which the two adjacent ranges of N notched wheels are disposed symmetrically inside or outside a cylindrical or spherical ring.

15. A composite material part for automotive and/or aeronautic construction parts, girders, A-pillars, B-pillars, C-pillars, motor suspension parts, strengthening or reinforcement beams, comprising at least a triaxial textile armature according to claim 1 together with a resinous or plastic material.

* * * * *